United States Patent [19]

Finsterwalder

[11] 3,975,476

[45] Aug. 17, 1976

[54] METHOD FOR BUILDING A CABLE-STAYED GIRDER BRIDGE

[75] Inventor: Klemens Finsterwalder, Socking near Starnberg, Germany

[73] Assignee: Dyckerhoff & Widmann Aktiengesellschaft, Munich, Germany

[22] Filed: Mar. 18, 1975

[21] Appl. No.: 559,490

[30] Foreign Application Priority Data

Mar. 22, 1974 Germany ..... 2413815

[52] U.S. Cl. ..... 264/33; 14/23

[51] Int. Cl.[2] ..... E04B 1/16

[58] Field of Search ..... 14/18, 19, 20, 22, 77, 14/23, 1; 264/33

[56] References Cited

UNITED STATES PATENTS

| | | | |
|---|---|---|---|
| 746,679 | 12/1903 | Cross | 14/19 |
| 965,358 | 7/1910 | Aylett | 14/18 X |
| 2,059,693 | 11/1936 | Hamilton | 14/20 X |
| 3,003,219 | 10/1961 | Suter | 264/33 |
| 3,259,932 | 7/1966 | Patin | 14/18 |
| 3,425,076 | 2/1969 | Finsterwalder | 264/33 |
| 3,571,835 | 3/1971 | Buechler | 264/33 X |
| 3,832,748 | 9/1974 | Ogletree | 14/77 X |
| 3,845,515 | 11/1974 | Gelhard | 14/77 |

FOREIGN PATENTS OR APPLICATIONS

| | | | |
|---|---|---|---|
| 1,658,582 | 5/1972 | Germany | 14/18 |
| 2,036,924 | 3/1971 | Germany | 14/77 |

*Primary Examiner*—Nile C. Byers
*Attorney, Agent, or Firm*—Toren, McGeady and Stanger

[57] ABSTRACT

A cable-stayed girder bridge having a concrete deck girder which includes longitudinally extending stiffening girders having cables embedded therein and a laterally extending deck portion is constructed by sequential formation of said deck girder in successive adjacent sections. The longitudinally extending stiffening girder portions of said deck girder are first formed, support cables are embedded therein and subsequently tensioned. After hardening of the stiffening girders, the laterally extending deck portion of the duck girder is formed. A form carrier movable along the bridge during its construction extends in a cantilevered arrangement from a previously formed deck girder section to provide support for a successive deck girder section during formation thereof.

1 Claim, 8 Drawing Figures

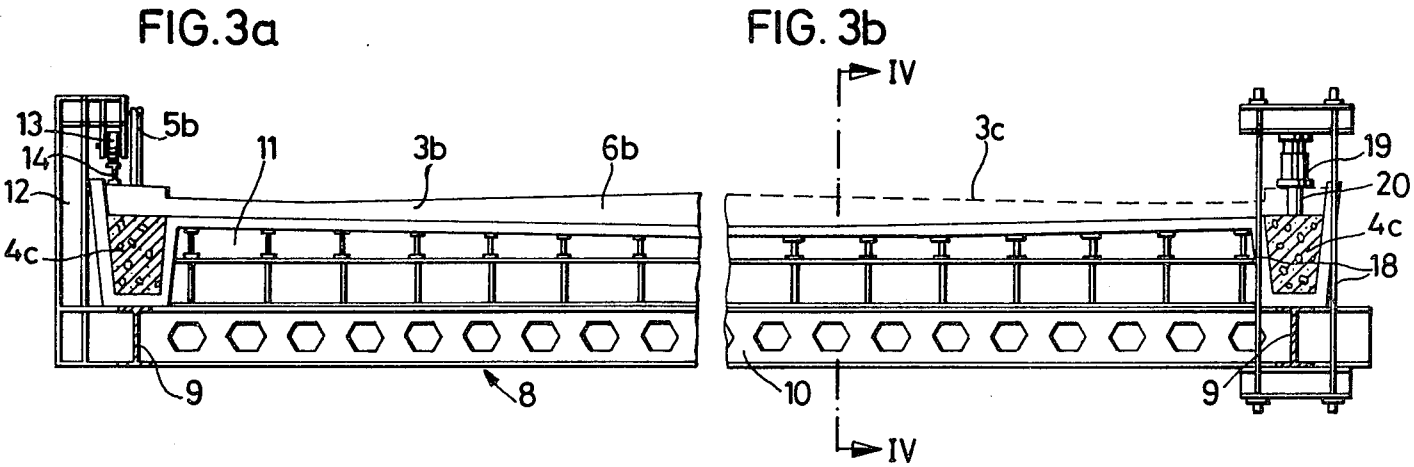
FIG. 3b
FIG. 3a
IV
IV
3c
6b
3b
11
5b
13
14
12
4c
8
9
10
19
20
18
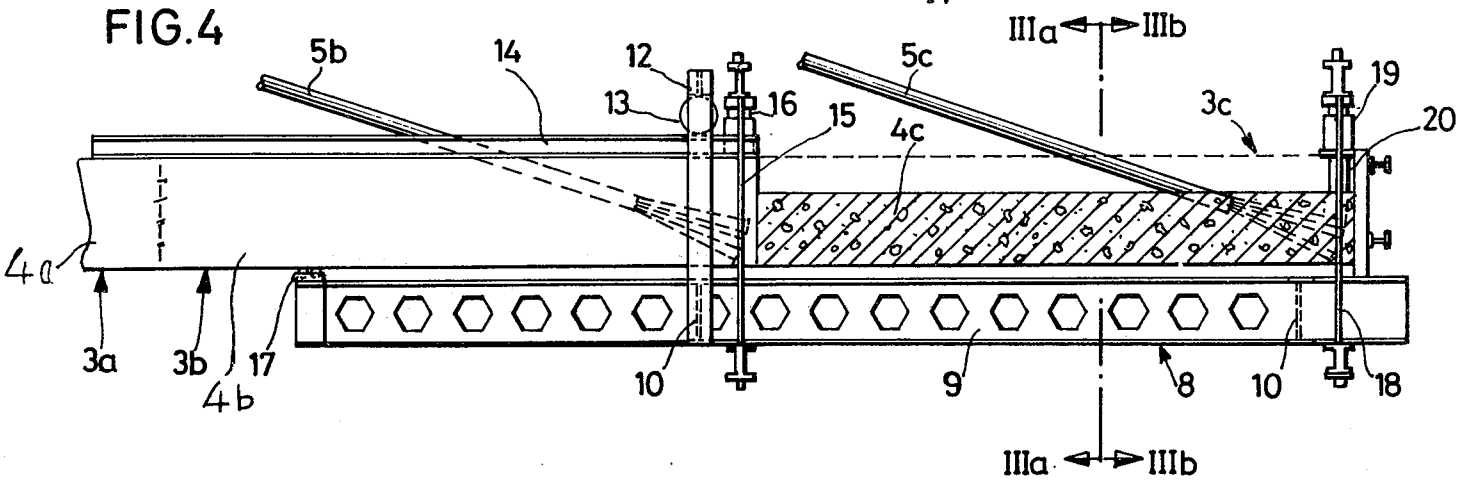
FIG. 4
IIIa
IIIb
IIIa
IIIb
3c
5c
4c
15
16
12
13
14
5b
17
4b
3b
3a
4a
8
9
10
18
19
20

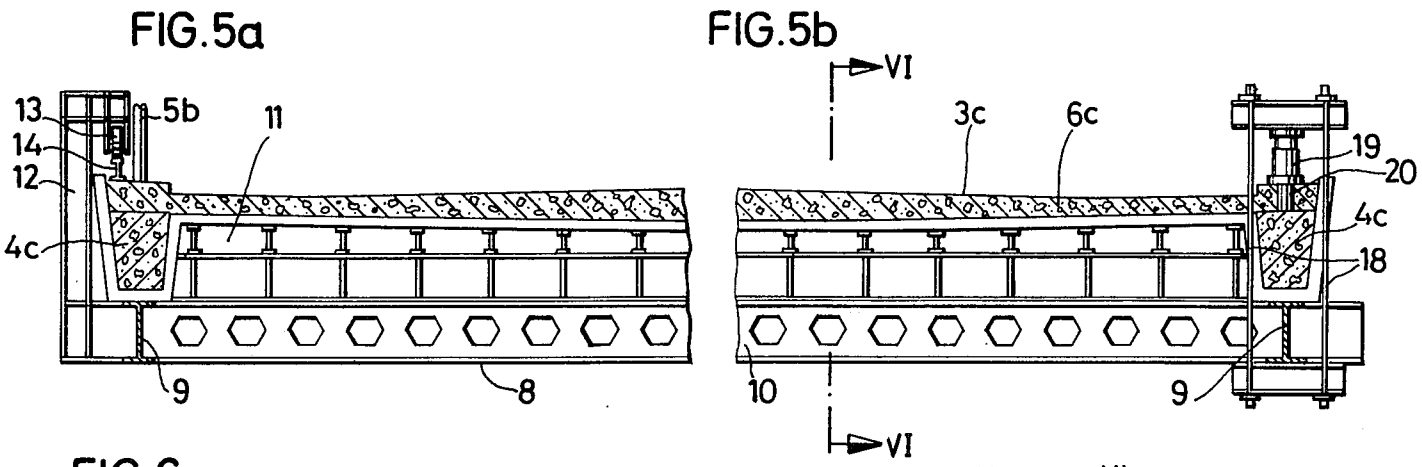
FIG.5b
FIG.5a
VI
VI
3c
6c
4c
18
20
19
9
10
8
11
5b
13
14
12
4c
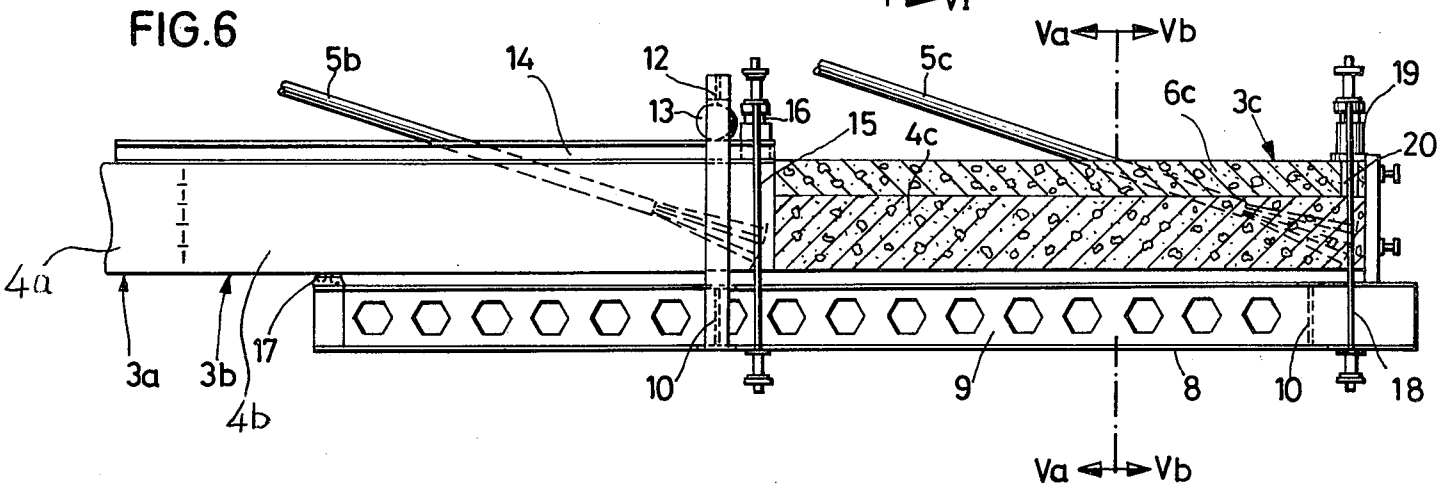
FIG.6
Va
Vb
Va
Vb
19
20
18
10
3c
6c
8
9
5c
4c
15
16
12
13
10
14
5b
17
4b
3b
3a
4a

METHOD FOR BUILDING A CABLE-STAYED GIRDER BRIDGE

BACKGROUND OF THE INVENTION

The present invention relates generally to bridge construction techniques and more particularly to a method for building the deck structure of a cable-stayed girder bridge. The invention is particularly intended for utilization with the type of construction technique which involves formation of the deck girder section of a bridge in sequential stages with adjacent sections of the deck girder being successively formed. In the type of construction technique to which the present invention relates, a form carrier which is movable along the bridge during its formation is utilized. As each successive bridge section is formed, the form carrier is moved to extend in a cantilevered arrangement from a previously formed bridge section in order to thereby provide support for a successive bridge section during its formation.

The successively formed deck girder of the bridge consists of reinforced or prestressed concrete. With the formation of each segment of the deck girder, anchoring of the bridge support cables is effected and the anchored cables are tensioned prior to formation of a next section.

In bridges constructed from reinforced or prestressed concrete, it has been known to build the bridge superstructure in the form of two projecting arms which extend from a pier toward opposite sides and which consist of concrete cast in situ or of precast concrete units. The production occurs in successive cantilevered segments from a form carrier which is secured on a completed section of the bridge superstructure and which projects beyond the end thereof. Such a form carrier is moved on rollers along the bridge superstructure to enable formation of the next respective cantilever segment.

In the construction of bridge superstructures in a cantilever form of construction, a problem arises during the construction stage of the bridge with regard to adaption, to the fullest extent possible, of the static principle system of the unfinished bridge to the static system of the finished bridge. Only in this way can there be avoided problems such as the receipt by individual members of loads which are higher during the construction stage of the bridge than when the bridge is in its finished state. Also, in this manner, there may be avoided additional measures which might be required to absorb loads which occur only during the relatively short period of bridge construction, which measures might include the provision of additional reinforcements, auxiliary supports or the like.

A cable-stayed girder bridge usually consists of a deck girder which is carried by abutments and piers and additionally by a system of straight cables which extend obliquely from the approaches by way of one or more pylons to the main span or spans. The cables extend generally in vertical planes, either in a plane within the longitudinal axis of the bridge or on either side along the edges of the deck's girder. As the loads of a cable-stayed girder bridge are supported essentially by oblique cables, the deck girder does not have a great deal of bending strength. For this reason, cantilevering of a cable-stayed girder bridge, though possible in principle, presents difficulties because, due to the low bending strength of the deck girder, the pouring loads of the respective front cantilevered sections can be shifted back only to the previously produced section so that this section and the cable anchored therein are under greater load than in the final state of the bridge.

The present invention is aimed at overcoming many of the aforementioned problems. With utilization of the present invention, there may be obtained in the building of a cable-stayed girder bridge formed in successive cantilever sections, a better adaptation of the static principle system in the building stage of the bridge relative to the final system of the finished bridge whereby making possible a more economic production method for such a bridge.

Briefly, the present invention may be described as a process for the construction of a cable-stayed girder bridge which has a concrete deck girder including longitudinally extending stiffening girders and a laterally extending deck. The process is performed by sequential formation of the deck girder in successive adjacent sections utilizing a form carrier movable along the bridge and adapted to be cantilevered from a previously formed deck girder section to provide support for a successive deck girder section during its formation. The bridge of the type to which the present invention relates is supported from pylons anchored in the earth. Cables extend from the pylons to the longitudinal stiffening girders of the deck girder. The particular improvement of the present invention involves formation of the deck girder by first forming the longitudinal stiffening girders with the cables embedded therein. The longitudinal stiffening girders are permitted to set and harden and the cables embedded therein are subsequently tensioned between pylons and the formed stiffening girders. As a result, the cables may be utilized to provide additional support for the partially formed deck girder. During the pouring of the stiffening girders, the form carrier is arranged to extend in cantilever fashion from a previously formed deck girder. After formation of the stiffening girders, the form carrier is connected to the formed stiffening girders to thereby enable additional support to be provided for the section being constructed. Finally, the laterally extending deck portion of the deck girder may be formed and this stage of the construction of the bridge may be effected with the advantage that the cables enhance the support which would otherwise be provided only by the form carrier.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described a preferred embodiment of the invention.

DESCRIPTION OF THE DRAWINGS

In the drawings:

FIGS. 3*a* and 3*b* are transverse sectional views of a bridge formed in accordance with the present invention showing an initial stage of bridge construction, with FIG. 3*a* being a view looking in the direction of the arrows IIIa—IIIa and FIG. 3b being a view looking in the direction of the arrows IIIb—IIIb of FIG. 4;

FIG. 4 is a longitudinal sectional view of the bridge depicted in FIG. 3 taken along the line IV—IV;

FIGS. 5a and 5b are transverse sectional views showing the bridge in a subsequent phase of construction with FIG. 5a being a view looking in the direction of the arrows Va—Va of FIG. 6 while FIG. 5b is a view looking in the direction of the arrows Vb—Vb of FIG. 6; and FIG. 6 is a longitudinal sectional view of the bridge structure depicted in FIG. 5b taken along the line VI—VI.

DETAILED DESCRIPTION OF THE PREFERRED EMBODIMENT

Figure 2:
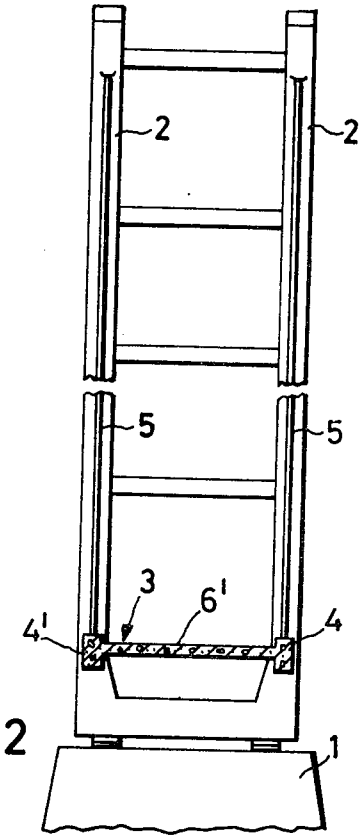
FIG. 2 is a sectional side view of the bridge of FIG. 1 taken along the lines II—II.
Figure 1:
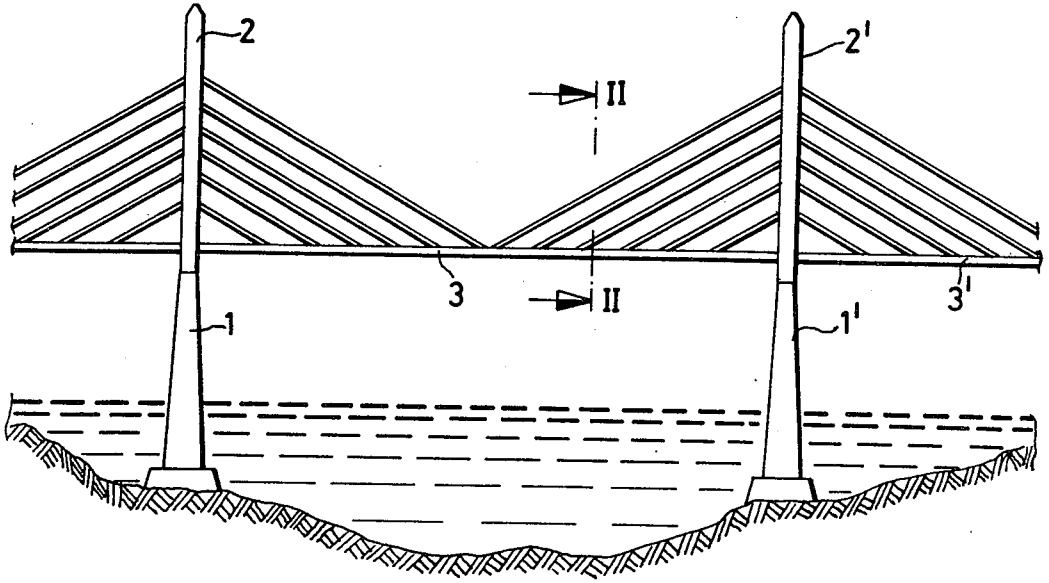
FIG. 1 is a side view showing an overall bridge construction produced by utilization of the present invention.

Referring now to the drawings, there is depicted a cable-stayed girder bridge which is supported from piers 1 extending to below the surface of a body of water which is to be spanned by the bridge structure and which are anchored in the earth. Pylons or towers 2 extend upwardly from the piers 1. The bridge comprises a deck girder 3 which is formed of prestressed concrete and which comprises two longitudinally extending stiffening girders 4 in which cables 5 are anchored. The cables 5 extend between the pylons 2 and the stiffening girders 4. Between the stiffening girders 4 a lateral deck portion 6 of the deck girder 3 is provided. The cables 5 extend from the pylons 2 in generally parallel relationship relative to one another and they are, in the finished bridge structure, maintained in tension between the pylons 2 and the stiffening girders 4.

FIGS. 3a and 3b are partial sectional views taken transversely of the bridge structure each showing the bridge when viewed in opposite directions. In FIG. 3a, there is depicted a portion of the bridge looking rearwardly toward previously constructed sections. FIG. 3b shows the bridge structure when viewed forwardly in the direction in which construction is occurring. Thus, with respect to FIG. 4, which shows a longitudinal sectional views of the bridge, the construction of the bridge takes place in a direction extending rightwardly of the view of FIG. 4. In the construction of the bridge in cantilevered segments, the deck girder is produced in sequentially formed successive segments. The segments of the deck 6 are marked 6a, 6b, 6c etc. and those of the two outer stiffening girders 4, in which the cables are anchored are marked 4a, 4b, 4c, etc. The deck girder 3 is produced in individual cantilever segments 3a, 3b, 3c etc., each having one cable or two cables 5a, 5b, 5c etc. assigned thereto.

In the bridge structure depicted in the drawings, a cantilever segment 3b of the overal deck girder has been completed and a cable 5b is embedded therein. After formation of the segment 3b, a form carrier 8 is placed in position for the production of the next successive cantilever segment 3c which is to have attached thereto a cable 5c.

The form carrier 8 consists of two longitudinal girders 9 which are arranged proximate and below the stiffening girders 4. The longitudinal girders 9 are connected by cross girders 10. Thus, the form carrier 8 essentially consists of a girder grate which rests upon shuttering 11 for the deck girder 3.

During the formation of the successive deck girder segment 3c, the form carrier 8 is supported at its rear end upon the front end of the cantilever segment 3b by wheels 13 which engage rails 14 provided on the top of the stiffening girder 4. To relieve the carriage during concrete pouring, tendons 15 are provided which may be tensioned by hydraulic jacks 16. The form carrier 8 is braced on the back of the longitudinal girders 9 against the underside of the stiffening girders 4 by rollers 17.

FIGS. 3a and 3b show transverse sections through the cantilever segment 3c which is to be produced in a state in which the stiffening girder members 4c have just been formed. The illustration has been selected so that the left half, i.e. FIG. 3a, shows a section looking rearwardly while the right half, i.e. FIG. 3b, shows a section looking forwardly. It will be noted that during this initial stage of formation, the stiffening girders 4c have been formed but the laterally extending deck portion 6c has not as yet been formed.

After setting of the concrete forming the stiffening girders 4c, the cables 5c anchored therein are tensioned. Thus, the cables 5c will be loaded between the pylons 2 and the stiffening girders 4c. At this point, the form carrier 8 may be secured at the front end of the longitudinal girders 9 over additional tendons 18 with interposition of hydraulic jacks 19 at the stiffening girder members 4c thus enabling a direct bearing of the loads of the member 6c by the cables 5c.

Accordingly, by initially forming the stiffening girders 4c, the support for the subsequently formed lateral deck portion may be enhanced by utilization of the cables 5c. As a result, the deck girder segment being formed will be supported not only by the form carrier 8 but there will also be applied to the end of the form carrier 8 additional support by means of the cables 5c.

If, as in the examples shown in the drawings, the stiffening girders are produced only to the height of the lower edge of the deck 6, as is favorable for reasons of weight, it becomes necessary to bridge the missing portion of the height for the support of the jacks 19 by a spacer 20 which may, for example, be a tube section, a block or the like.

After the initial stage of formation depicted in FIGS. 3a, 3b and 4, the subsequent stage of formation depicted in FIGS. 5a, 5b and 6 may be achieved. With the cable 5c extending to support the deck girder segment being formed, the concrete for the lateral deck 6c may be poured. Such pouring may be done with greater facility by virtue of the fact that the added structural support previously described has been afforded. After the setting of the concrete of the member 6c of the deck, as shown in FIGS. 5a or 5b, the anchorings of the tendons 15 and 18 may be released whereby the form carrier 8 supported upon the rails 14 by the wheels 13 may be moved forwardly to enable production of the next successive segment of the bridge deck girder.

In the formation of bridges of the type depicted in the drawings, it is ordinarily necessary to construct the deck structure by proceeding in directions away from the pylons 2. Thus, a first deck girder is normally formed adjacent a pylon 2 and successive deck girders 3 may then be formed utilizing the techniques of the present invention by proceeding from the first deck girder thus formed in a direction away from the pylon. The procedure for forming such a first deck girder may be in accordance with techniques known in the prior art and thus a detailed description thereof is not deemed necessary for a complete understanding of the present invention.

From the foregoing it will be seen that the present invention provides a method which overcomes many of the problems of the prior art discussed hereinbefore. Each cantilever section is produced by first forming the part of the deck girder situated in the zone of the cable plane or planes with the cables being anchored therein. After this portion of the deck girder has set and hardened, the cable or cables anchored therein may be tensioned and a form carrier may be additionally supported through the cables embedded therein. Thereafter, the remaining portion of the deck girder may be produced.

With the method according to the present invention, much better adaptation of the static principle system of the bridge in its construction stage to the final system may be obtained. This is achieved in that there is first formed only a part of the deck girder with the aid of the projecting form carrier with this initially formed part being that part in which the oblique cables are anchored. These cables may be installed very early and under very low load of the previously produced portion of the bridge superstructure. For the absorption of the weight of the remaining portion of the deck girder to be produced in the second building segment, even though it is usually the greater portion, there are then available in each cantilever segment the cables already anchored therein so that not only these cables but also the previously connected cables may be stressed during stages of construction in the same manner and in approximately the same amount as in the final bridge structure.

An advantage of the present invention involves the fact that in the projecting state, the form carrier is required to carry only a small part, about ¼ to ⅓, of the load of the total cantilever segment being formed. Thus, not only may the production steps be carried out more easily but there is enabled the formation of longer individual cantilever segments of the deck girder. This, in turn, has a favorable effect upon construction time and profitability of the entire construction process.

While a specific embodiment of the invention has been shown and described in detail to illustrate the application of the inventive principles, it will be understood that the invention may be embodied otherwise without departing from such principles.

What is claimed is:

1. A process for the construction of a deck structure in a cable-stayed girder bridge, by sequential formation in successive adjacent sections of a plurality of concrete deck girders each of which include longitudinally extending stiffening girders and a laterally extending deck portion, said bridge including pylons anchored in the earth to support said concrete deck girders from cables extending between said pylons and said longitudinal stiffening girders, comprising the steps of providing a form carrier adaptable to have concrete poured thereinto to form said deck girders, arranging said form carrier to be cantilevered longitudinally from and below a previously formed deck girder section to provide support for a successive deck girder section during formation thereof, first forming said longitudinal stiffening girders for said successive deck girder section with cables embedded therein, subsequently tensioning said embedded cables between said pylons and said formed longitudinal stiffening girders to provide support therefor, thereafter connecting said form carrier to said formed stiffening girders to thereby provide further support therefor from said previously tensioned cables, thereafter forming said laterally extending deck portion of said successive girder section, subsequently moving said form carrier to be cantilevered longitudinally from said deck girder section thus formed, and thereafter repeating said steps to form said deck structure from said successive adjacent deck girder sections.

* * * * *